US006729043B2

(12) United States Patent
Mühlböck

(10) Patent No.: US 6,729,043 B2
(45) Date of Patent: May 4, 2004

(54) METHOD FOR DRYING STACKED WOOD

(76) Inventor: Kurt Mühlböck, Fleischhacken 10 A 4906, Eberschwang (AT)

( * ) Notice: Subject to any disclaimer, the term of this patent is extended or adjusted under 35 U.S.C. 154(b) by 0 days.

(21) Appl. No.: 10/314,588

(22) Filed: Dec. 9, 2002

(65) Prior Publication Data

US 2003/0106238 A1 Jun. 12, 2003

(30) Foreign Application Priority Data

Dec. 10, 2001 (AT) ..... 1931/2001

(51) Int. Cl.[7] ..... F26B 3/00
(52) U.S. Cl. ..... 34/491; 34/451; 34/487
(58) Field of Search ..... 34/451, 467, 486, 34/487, 491, 490, 492

(56) References Cited

U.S. PATENT DOCUMENTS

| | | | | | |
|---|---|---|---|---|---|
| 5,107,607 | A | * | 4/1992 | Mason | 34/191 |
| 5,179,789 | A | * | 1/1993 | Stroud et al. | 34/491 |
| 5,197,201 | A | * | 3/1993 | Salin | 34/487 |
| 5,416,985 | A | * | 5/1995 | Culp | 34/487 |
| 5,983,521 | A | * | 11/1999 | Thompson | 34/379 |
| 6,357,144 | B1 | * | 3/2002 | Nilsson et al. | 34/467 |

FOREIGN PATENT DOCUMENTS

| | | |
|---|---|---|
| DE | 3738806 | 5/1989 |
| DE | 19522028 | 12/1996 |
| DE | 29723003 | 7/1998 |

* cited by examiner

*Primary Examiner*—Ira S. Lazarus
*Assistant Examiner*—Kathryn S. O'Malley
(74) *Attorney, Agent, or Firm*—Collard & Roe, P.C.

(57) ABSTRACT

A method and an apparatus is proposed for drying stacked wood with the help of a drying gas guided in a circulatory flow. The stacks of wood (H1, H2) are charged zone by zone depending on the average moisture of the wood (u) in the respective zone with partial streams of the drying gas which differ with respect to their drying power. In order to achieve the most even final humidity (E) of the individual stacks of woods (H1, H2) it is proposed that the stacks of wood are dried in the zone with the on average highest wood moisture (u) with a permissible maximum speed up to the fiber saturation point (F) and the other zones (2) are dried within the terms of achieving the fiber saturation point (F) with different speeds in the time interval as predetermined by the zone with the most moisture before the stacks of wood (H1, H2) are dried in an even circulatory flow to the predetermined final moisture (E), and that the average moisture of the wood used for determining the drying speeds is determined in a heat-up phase (A) from the heat quantity supplied to the wood.

9 Claims, 4 Drawing Sheets

METHOD FOR DRYING STACKED WOOD

1. Field of the Invention

The invention relates to a method for drying stacked wood with the help of a drying gas guided in a circulatory flow, with the stacks of wood being charged zone by zone depending on the average moisture of the wood in the respective zone with partial streams of the drying gas which differ with respect to their drying power, and to an apparatus for performing the method.

2. Description of the Prior Art

Sawn timber is dried to a large part in wood drying systems to a desired final moisture. It is always a goal, after the completion of the drying process, to obtain the most uniform final moisture of the batch of wood. A batch of sawn timber is introduced into a treatment chamber for drying purposes and then dried at predetermined drying temperatures and at high air humidities. In the interior of the treatment chamber a circulatory flow for heated drying gas through the sawn timber is produced with fans. In order to ensure an even temperature distribution in the treatment chamber it is necessary to introduce any ambient air that may have been introduced into the treatment chamber as evenly as possible over the cross section of the treatment chamber, which on the other hand is a necessary precondition for an even distribution of the air moisture within the chamber. Since temperature differences in the treatment chamber lead to uneven final humidities it is known to divide the treatment chambers into several zones in order to regulate in these zones the chamber temperature separately per se to the common setpoint value applicable for the entire treatment chamber. Every zone comprises its own temperature sensors and has its own actuators for associated heating registers or groups of heating registers through which the temperature of the drying gas for each zone is regulated. Usually, the regulation of the heating register temperature occurs in such a way that the drying gas circulated in the treatment chamber and emerging from the stack is held at a constant temperature, as a result of which an evening of the transmitted thermal output occurs between the individual zones. The evaporation of the moisture supplied by the wood leads in each zone to a temperature drop which is inversely proportional to the circulated air quantity. It may occur with this type of regulation that the inlet temperature exceeds a permissible limit temperature and thus damage to the wood (formation of cracks, etc.) occurs.

Known apparatuses for drying stacked timber in a drying gas (DE 297 23 003 U1, DE 37 38 806 A1) comprise, among other things, a drying chamber, fans for circulating the drying gas and heating registers for heating the drying gas. For exchanging the drying gas in the heating chamber it is provided with a feed and discharge line for the drying gas, with valves being provided in the feed and discharge lines for regulating the exchange routes. These known apparatuses comprise only one zone however, so that they can hardly be used to achieve even wood humidities after a drying process when the treatment chamber is charged with wood batches of different moisture.

The goal in the known drying methods is always providing the drying power in a treatment chamber as evenly as possible over the entire cross section. As a result of the even drying power in the individual zones it is always noticed that the final moisture is not within the desired narrow margin. Such differences in final moisture are especially clear when the wood is dried so as to achieve relatively high final moisture values. This leads to the consequence that a batch of wood simultaneously contains considerable shares of wood that is insufficiently dried and wood that is too humid, which leads to a considerable share of rejects.

In the case of an even distribution of the mean initial humidities per zone, a favorable, even final moisture of the wood batch is achieved with the known method. However, if the initial moisture distribution of the individual zones is different, this distribution will have a direct influence on the final result due to the desired even drying power. Differences in initial moisture can be felt in particular which are present in the longitudinal direction of the chamber because there is no considerable exchange of air transversally to the direction of flow of the circulated drying gas in the treatment chamber.

It is known from DE 19522028 A1 to check the drying by means of individual wood moisture measuring points within each zone. This requires a plurality of measuring points which on the one hand require a high amount of investments and maintenance in practice and on the other hand are time-consuming in mounting them and finally lead to a far from inconsiderable risk concerning the correct assignment of the measuring points to the individual zones. These methods are hardly used in practice for such reasons and because the known wood moisture sensors supply especially imprecise measurement results in the region of high wood humidities.

A connection that can be formulated mathematically between the respective moisture content and the drying rate can only be obtained in wood, and such of coniferous trees in particular, below the fiber saturation point. The fiber saturation point represents the moisture content below which no free water is any longer contained in the wood. Since above the fiber saturation point the drying rate is substantially only dependent on the supplied heat quantity, but not on the moisture content, a moisture balance can only be produced in a moisture region between the fiber saturation point and the desired final moisture according to a connection that can be formulated mathematically, i.e. in a comparably low moisture range of 12 to 25%, assuming an average fiber saturation point of 30 to 35% and a final moisture of 10 to 18%. The usual wood humidities at the beginning of the drying process lie in the range of between 50% and 150%. The differences in the moisture content that still exist after the drying above the fiber saturation point would thus have to be compensated in relatively short intervals, which would lead to extremely small drying rates and, consequently, small temporal temperature differences with the disadvantage of relatively high measurement errors.

SUMMARY OF THE INVENTION

The invention is therefore based on the object of providing a method of the kind mentioned above in such a way that a substantial moisture balance can be ensured in comparatively short time intervals, namely by maintaining a predetermined final moisture. Moreover, an apparatus is to be created with which it is possible to stack wood of different initial moisture without prior sorting into a treatment chamber and still achieve an even mean final moisture of the wood batch.

This object is achieved in accordance with the invention in such a way that the stacks of wood are dried in the zone with the on average highest wood moisture with a permissible maximum speed up to the fiber saturation point and the other zones are dried within the terms of achieving the fiber saturation point with different speeds in the time interval as predetermined by the zone with most moisture before the stacks of wood are dried in an even circulatory flow to the predetermined final moisture, and that the average moisture of the wood used for determining the drying speeds is determined in a heating phase from the heat quantity supplied to the wood.

A simple method is created by the invention which allows balancing average differences in moisture in the individual zones above the fiber saturation point, i.e. at a time at which there is still an at least approximately linear drying behavior of the wood. The zone in which the on average largest wood moisture is present is dried with a still permissible speed up to the fiber saturation point, at which speed there is still no damage to the wood. The drying speed in the other zones is reduced relatively to this in such a way that each zone achieves the fiber saturation point at approximately the same time. According to the invention it is relevant that the mean differences in moisture in the individual zones are balanced at the latest when the fiber saturation point has been reached. Below the fiber saturation point the stacks of wood of all zones are dried in a uniform circulatory flow to the predetermined final moisture.

In order to determine the differences of the average wood humidities between the individual zones as precisely as possible, the mean moisture of the wood is determined in a heat-up phase from the heat quantity supplied to the wood. This heat quantity is composed in the known manner from the oven-dry weight (wood at 0% moisture) and the heat quantity supplied to the water contained in the wood. With the knowledge of the quantity of wood as introduced into the treatment chamber and the heat quantity supplied to the wood it is possible to determine the moisture content of the wood. It is especially advantageous when the mean moisture of the wood is determined in zones during the heat-up phase of the drying gas guided in a circulatory fashion from the heat quantity that is supplied to the wood during a monitoring period.

The determination of the heat quantity supplied to the wood occurs for example from the product of the temperature difference between the entrance of the drying gas into and the exit out of the stack with the mass of the circulated drying gas and a material constant of the drying gas. It is thus merely necessary to acquire the temperature difference between stack entrance and stack exit with at least one temperature sensor each, thus leading to a cost-effective, precise method for determining the supplied heat quantity. In order to determine the heat quantity supplied to the wood even more precisely, the heat quantity which is emitted to the drying gas by a heat exchanger and supplied to the wood is further determined from the product of the temperature difference between advance flow temperature and return flow temperature of the heat exchanger with the mass of the heating medium circulated per unit of time in the heat exchanger and a material constant of the heating medium. In order to calculate the heat quantity supplied to the wood, it is possible to use either the one or the other method. It is advisable to always use the mean value of the two methods for calculating the moisture of the wood. In addition, the wood temperature or the stack exit temperature of the drying gas can be measured during the heat-up phase at at least one point per zone and supplied to a memory unit. The mass of the water contained in the wood can then be determined from the heat quantity supplied during the monitoring period to the wood and the wood temperature difference and/or the drying gas temperature difference between the beginning and end of the monitoring period with knowledge of the volume of wood to be dried. If an especially precise determination of the wood moisture is required, the temperature of the drying gas at entrance into and exit from the stack, the temperature difference between advance flow temperature and return flow temperature of the heat exchanger and the wood temperature difference between a start and end of the monitoring period are considered for calculating the heat quantity supplied to the wood.

Without any additional wood measuring points the new method allows determining the initial moisture distribution between the individual zones of a treatment chamber. The initial moisture content can be determined according to the new method from the heat quantity supplied to the wood during the heat-up phase and the associated temperature change of the wood. The relevant aspect for the method in accordance with the invention is that it is not the determination of a precise absolute moisture content of the wood of the individual zones is relevant for a precise final result of the drying process. Instead, merely the relative differences between the individual zones need to be determined. It is an additional advantage that the determination of the differences between the individual zones occurs in the state of maximum temperature differences between stack entrance and exit, thus producing the best possible measurement precision. In accordance with the invention, drying is started after the termination of the heat-up phase and the drying course is guided based on the most humid zone according to a drying schedule as chosen by the operator. For this purpose, the associated heating devices are regulated preferably in all zones to a predetermined stack exit temperature of the drying gas. In order to enable the quickest and simplest possible discharge of the steam quantity issued to the drying gas from the zone or the treatment chamber or in order to enable maintaining the drying speed, it is proposed in accordance with the invention that the drying speed to be maintained for each zone during the drying phase is controlled by the quantity of drying gas replaced by fresh gas. Within the terms of the desired even final moisture in all zones, a drying gas quantity is exchanged which differs in each zone from the determined initial moisture differences. In this process, the stack exit temperature of the drying gas is regulated in all zones either to a uniform value or the same quantity of drying gas is exchanged in each zone per unit of time and the stack exit temperature of the drying gas is controlled in all zones depending on the steam quantity to be discharged.

In order to obtain a lower scattering of the mean final moisture it is proposed that individual zones are subdivided into sub-zones in which the stack exit temperature of the drying gas is controlled depending on the drying speed to be maintained.

Apparatuses for drying stacked wood in a drying gas comprise a treatment chamber for example which is subdivided into at least two zones for receiving wood as well as a control unit. The drying gas for each zone is circulated by at least one fan over at least one heat exchanger and a temperature sensor. In order to ensure that the stacks of wood of a zone with the highest average wood moisture can be dried up to the fiber saturation point and the other zones can be dried in the same time interval with a respective lower speed to the fiber saturation point, at least one feed line and one discharge line for the exchange of the drying gas is provided. The exchange of air enriched with steam can occur in a simple fashion through said feed and discharge lines without influencing adjacent zones. In order to enable the regulation of the exchanged drying gas, the feed and/or discharge line is associated with a control valve and/or a blower. The control of the valves or the output of the blower is made in such a way that a certain basic position is predetermined depending on the measured values. This basic position can be valid for all valves or blowers of a zone and is overlapped by corrective values which are determined from the initial moisture. In this way a zone with low initial moisture will dry to a slower extent precisely by such an amount which is necessary in order to achieve the fiber saturation point at the same time as the zone with humid wood. Since the exchanged air quantity in the individual zones is precisely in proportion to the respectively required drying performance, the virtually same absolute drying gas moisture contents are obtained in all zones for physical reasons. As a result, a single sensor is sufficient for detecting the absolute air moisture per treatment chamber.

Alternatively, and especially in additionally defined sub-zones, the drying speed (=drying rate) can also be varied in such a way that the thermal output is varied via the detour of a value determined differently on purpose for the exit temperature of the air. The fact is made use of that under given conditions and fresh gas exchange rates the speeds in the individual zones depend in a manner that can be mathematically formulated on the difference of the exit temperatures, with decreasing exit temperatures leading to decreasing drying rates.

In order to regulate the heat quantity supplied per zone, each heat exchanger comprises at least one valve for throttling or blocking its heating medium. In order to prevent any mutual influencing of the partial streams of the drying gas which are circulated in the individual zones, the fan(s) and the heat exchanger form a heating device in each zone which are preferably separated preferably by means of guiding devices for the drying gas from the heating devices of other zones and at least partly by means of a inserted ceiling and/or a separating wall from the treatment chamber. A zone is created which is cut off on the one hand from the other zones and on the other hand from the treatment chamber, in which zone an exchange of the drying gas occurs and in which heat is supplied to the drying gas and the drying gas is circulated through the zone. In order to reduce the influencing of the individual zones among each other even further, the treatment chamber can be provided with separating devices between the individual zones. These could be insertable separating walls, rolling doors, louvers or the like.

If the moisture differences of the wood are to be even better compensated within the individual zones, it is necessary to subdivide the individual zones into sub-zones for which separate drying gas conduits are arranged. As a result, at the beginning of the drying process it is necessary to determine the moisture content of the wood in every single sub-zone and then it is necessary to dry every single sub-zone per se at a respective speed. For this purpose, heating registers are provided which are associated with the sub-zones, can be triggered or regulated separately from each other and regulate the drying speeds in the individual sub-zones through the heating gas temperature.

BRIEF DESCRIPTION OF THE DRAWINGS

The invention is schematically shown in closer detail in the drawings, wherein.

DESCRIPTION OF THE PREFERRED EMBODIMENT

Figure 1:
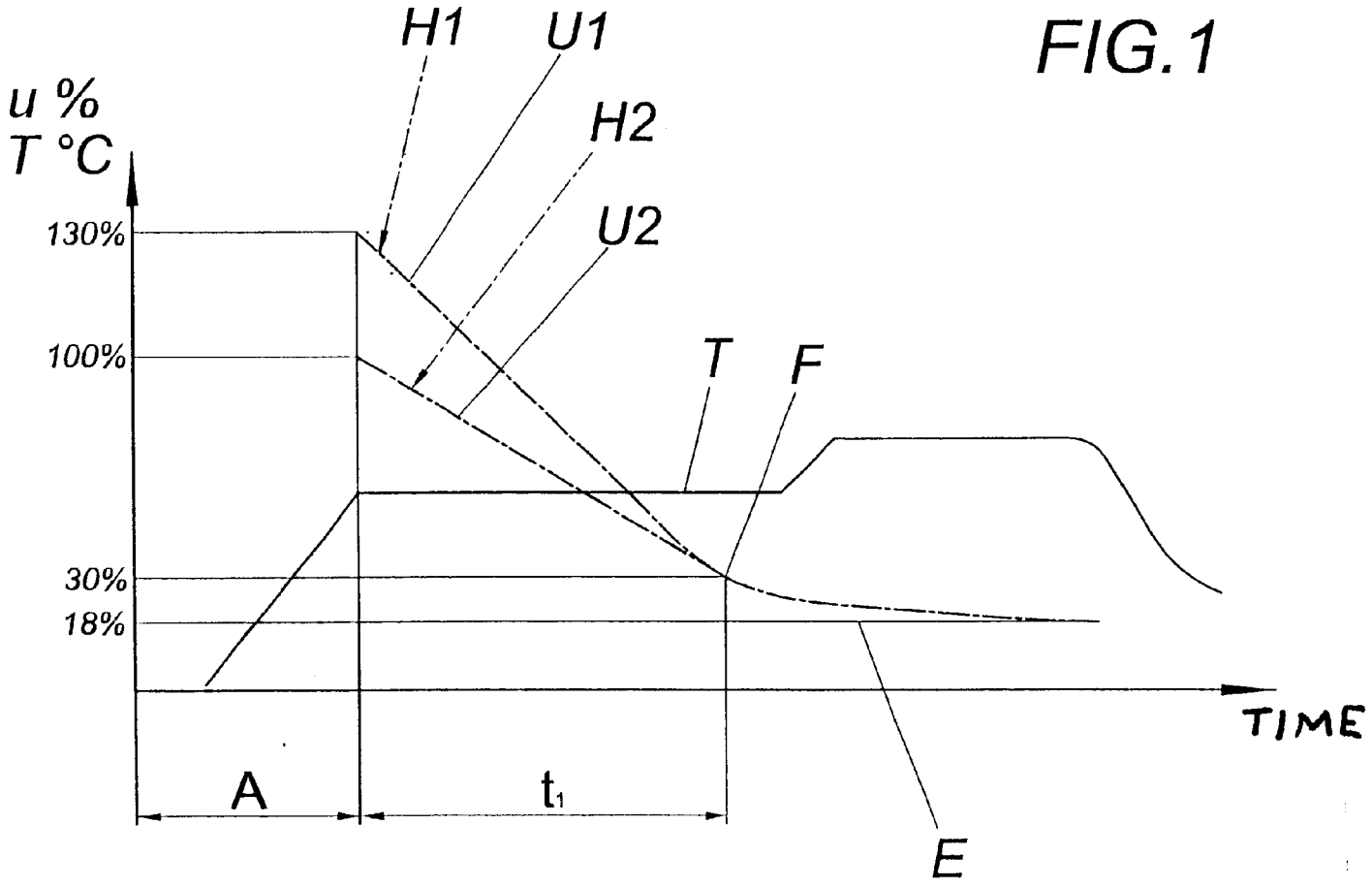
FIG. 1 shows a schematic for the procedure of a method in accordance with the invention.
Figure 2:
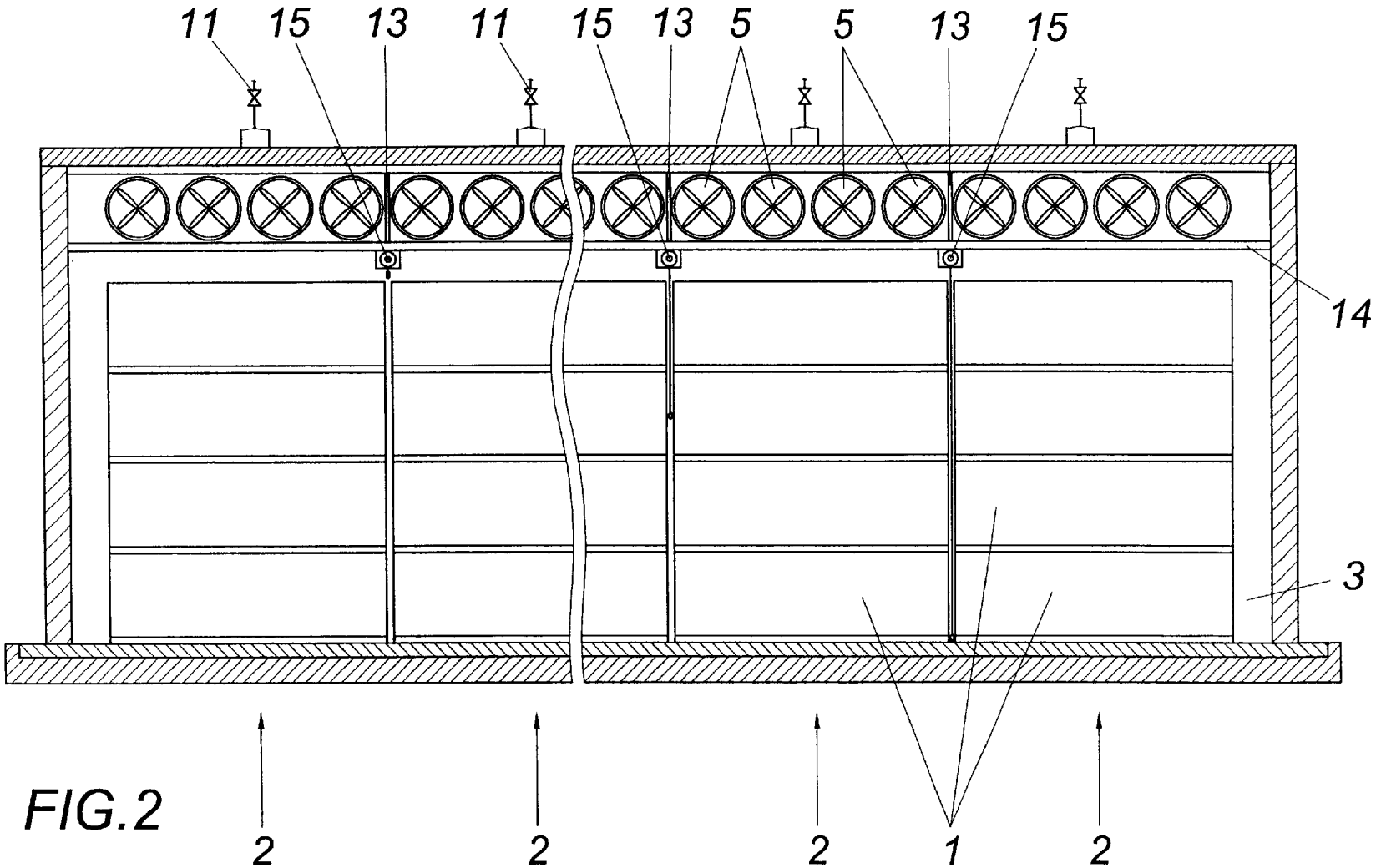
FIG. 2 shows an apparatus for performing the method in accordance with FIG. 1 for drying stacked wood in a partly sectional side view.

In accordance with the invention, the mean heat quantity which is supplied in zones to the wood or stacks of wood is determined in a heat-up phase A. The heat quantity supplied to the wood can be determined either from the temperature difference as determined over time of the drying gas between stack entrance and stack exit or from measured differences of the advance flow and return flow temperatures of the heating section.

Thermal power $\dot{Q}_{zu}$ [kJ/s] transmitted from the drying gas to the wood:

$$\dot{Q}_{zu}=cp_{Umluft}*\dot{m}_{Umluft}*\Delta T_{Luft} \text{ with}$$

$\dot{m}_{Umluft}$ drying gas mass [kg/s] circulated per unit of time;

$\Delta T_{Luft}$ drying temperature difference between entrance into and exit from stack [K]

$cp_{Umluft}$ mean specific heat capacity of drying gas [kJ/kg K].

In this connection it is possible to determine the thermal output supplied to the drying gas via heat exchangers:

$$\dot{Q}_{zu}=cp_{H2O}*\dot{m}_{H2O}*(T_{Vorlauf}-T_{Rucklauf}) \text{ with}$$

$\dot{Q}_{zu}$ the introduced power via the heat exchangers [kJ/s];

$\dot{m}_{H2O}$ the flow rate of a heating medium through the heat exchanger [kg/sec];

$\Delta T$ temperature difference between advance flow and return flow [K].

The relative heat quantities as absorbed by the wood are obtained in an observation period t as $$Q_{auf}=\dot{Q}_{zu}*t\ [kJ]$$

The wood humidity of each zone which is relevant for determining the relative drying rates (speed) is approximately proportional to the absorbed respective heat quantity $Q_{auf}$. In addition, the heat storage capacity of the wood can be determined directly during the observation period t via the energy absorbed by the wood. It is then possible to conclude from this the different water quantities to be dried.

$$Q_{auf}=(m_{HolzDarr}*cp_{HolzDarr}+m_{H2OHolz}*cp_{H2O})*\Delta T_{Holz}$$

$$m_{H2OHolz}=\left(\frac{Q_{auf}}{\Delta T_{Holz}}-m_{HolzDarr}*cp_{HolzDarr}\right)*\frac{1}{cp_{H2O}}$$

$$m_{H2OHolz}=\left(\frac{\dot{Q}_{zu}*t_{beobacht}}{\Delta T_{Holz}}-m_{HolzDarr}*cp_{HolzDarr}\right)*\frac{1}{cp_{H2O}}$$

with $m_{HolzDarr}$ oven-dry weight of introduced wood [kg];

$m_{H2O}$ the water quantity [kg] stored in the stacked wood, and $\Delta T_{Holz}$ temperature increase in the wood over the observation period t.

For the purpose of determining the relative differences it is usually sufficient in practice to calculate with a mean oven-dry weight of the wood which is typical for the respective chamber. The determination will be especially precise when the process is based on the actual value.

According to the method in accordance with the invention, drying is started after the end of the heat-up phase A and the drying progress is conducted on the basis of the moistest zone and the drying schedule as chosen by the operator. According to the embodiment, the exit temperature T from the stack of woods is regulated in all zones to the same setpoint value, as a result of which the drying rate is directly proportional to the drying gas quantity which is exchanged continuously for each zone. If air is used as the drying gas, it is merely necessary to remove air enriched with steam from the zone and to supply fresh ambient air to the zone. The stacks of wood of the zones with the on average highest wood moisture are dried with the permissible highest speed U1 until the fiber saturation point F of the wood H1 and the other zones are dried with a different speed U2 within the terms of achieving the fiber saturation point F in the drying interval $t_1$ which is predetermined by the moistest zone before the stacks of wood are dried in a uniform circulatory flow to a predetermined final humidity E. According to the embodiment, the wood H1 stored in zone 1 has a mean initial moisture of 130% and the wood H2 as stored in zone 2 has a mean initial moisture of 100%. The wood H1 and H2 of the two zones are dried in the same drying interval $t_1$ to the fiber saturation point F, i.e. to a moisture of approx. 30%. For this purpose it is necessary that the wood H1 is dried more quickly than the wood H2.

The method in accordance with the invention allows achieving more even final humidity values with a much higher amount of security as compared with the state of the art. The method is principally universally applicable to all materials that need to be dried and types of wood without requiring any knowledge of special material data and drying properties. As compared with the known units, it is possible to save drying time, energy and any additional efforts such as set-up times, etc., the reason being that it is not necessary to provide any prolongation of the drying time for compensating the uneven moisture distribution or to provide any second drying process, as a result of which the efficiency of the drying system increases. But not only the evenness of the drying result increases, the likelihood of underdrying and thus of crack formations and deformations decreases, thus reducing the number of rejects. As a result of the same dwell time of the wood at the same drying conditions above and below fiber saturation, the color result of the batch becomes more homogeneous.

Once the fiber saturation point F is achieved the drying is continued at the same temperature and with the same dry gas exchange per zone in order to dry towards the predetermined final humidity.

Figure 3:
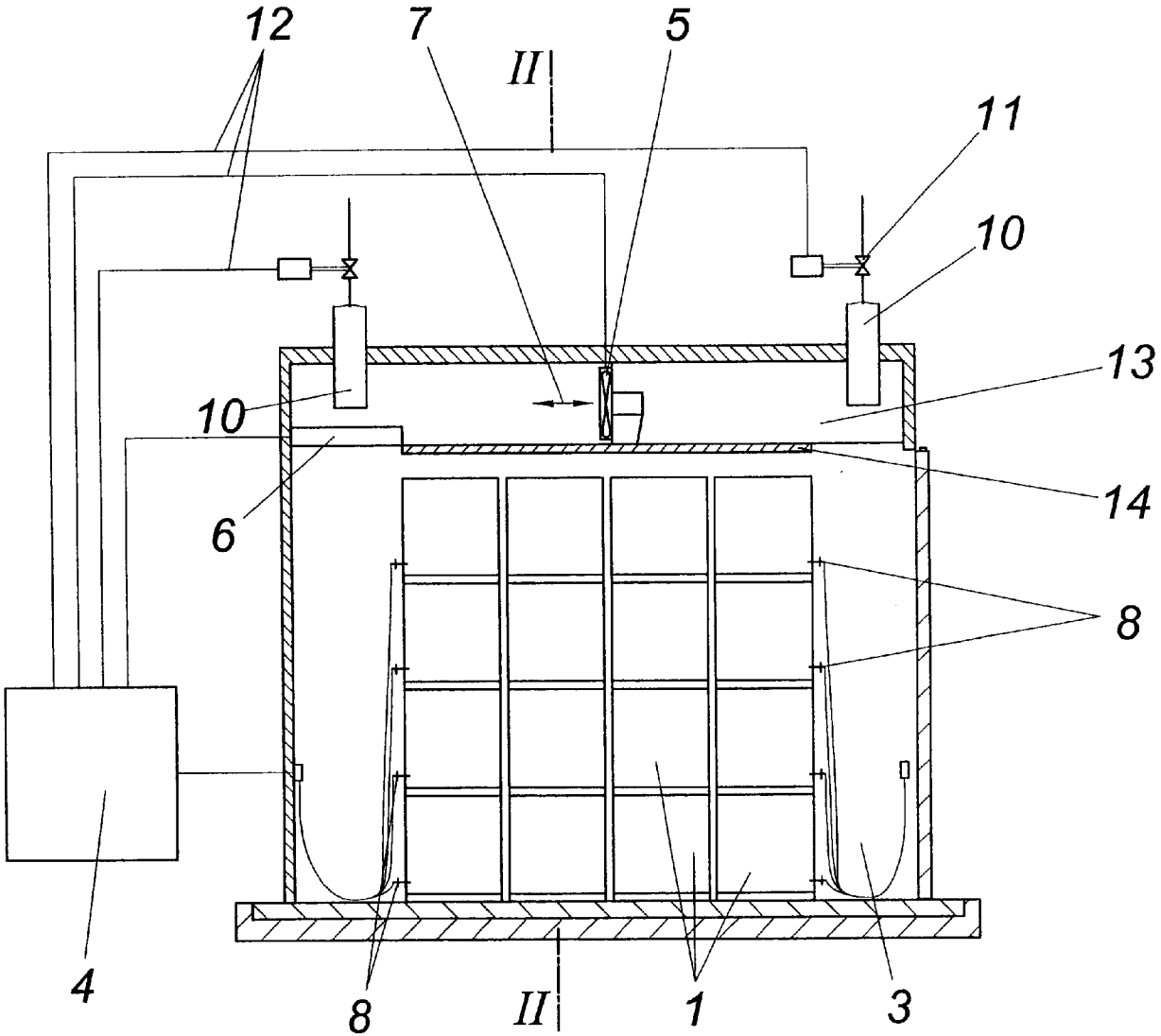
FIG. 3 shows the apparatus of FIG. 2 in a partly sectional front view.

The apparatus for drying stacked wood 1 consists of a treatment chamber 3 which is subdivided into several zones 2, and a control unit 4. In the treatment chamber 3, a drying gas, preferably air, is circulated by at least one fan 5 for each zone 2 over heat exchangers 6 transversally to the longitudinal direction of the treatment chamber 3. The drying gas is conveyed in the direction of arrow 7 by fan 5 and several temperature sensors 8 are situated at the exit from the stack, which temperature sensors 8 measure the stack exit temperature of the drying gas. Principally, one temperature sensor 8 per zone would suffice. It has proven to be advantageous, however, to provide several temperature sensors 8 and to determine a mean exit temperature. According to the embodiment of FIG. 3, the conveying direction of the fan 5 can be reversed several times during the drying process.

In order to ensure that each zone 2 can be dried with different speed to its fiber saturation point F, each zone 2 is associated with at least one feed and discharge line 10 for exchanging drying gas. The feed and discharge line each contain a control valve 11 and, optionally, a blower with which the quantity of the exchanged drying gas can be set. The control valves 11, the heat exchanger 6 and the fans 5 are connected with the control unit via lines 12. When the conveying direction of the drying gas in the treatment chamber 3 is reversed, the directions of flow in the feed and discharge lines 10 are also reversed.

The fan(s) 5 and the heat exchanger(s) 6 form a heating device for each zone, which heating device is separated by means of guiding devices 13 for the drying gas from the heating devices of other zones 2 and at least partly from the treatment chamber 3 by means of an intermediate ceiling 14 in order to improve the flow behavior of the drying gas in the treatment chamber 3 and to prevent any mutual influence of the drying gas of the individual zones 2. Between the zones 2 the treatment chamber 3 comprises separating devices 15 in the form of curtains or shutters or the like.

Figure 4:
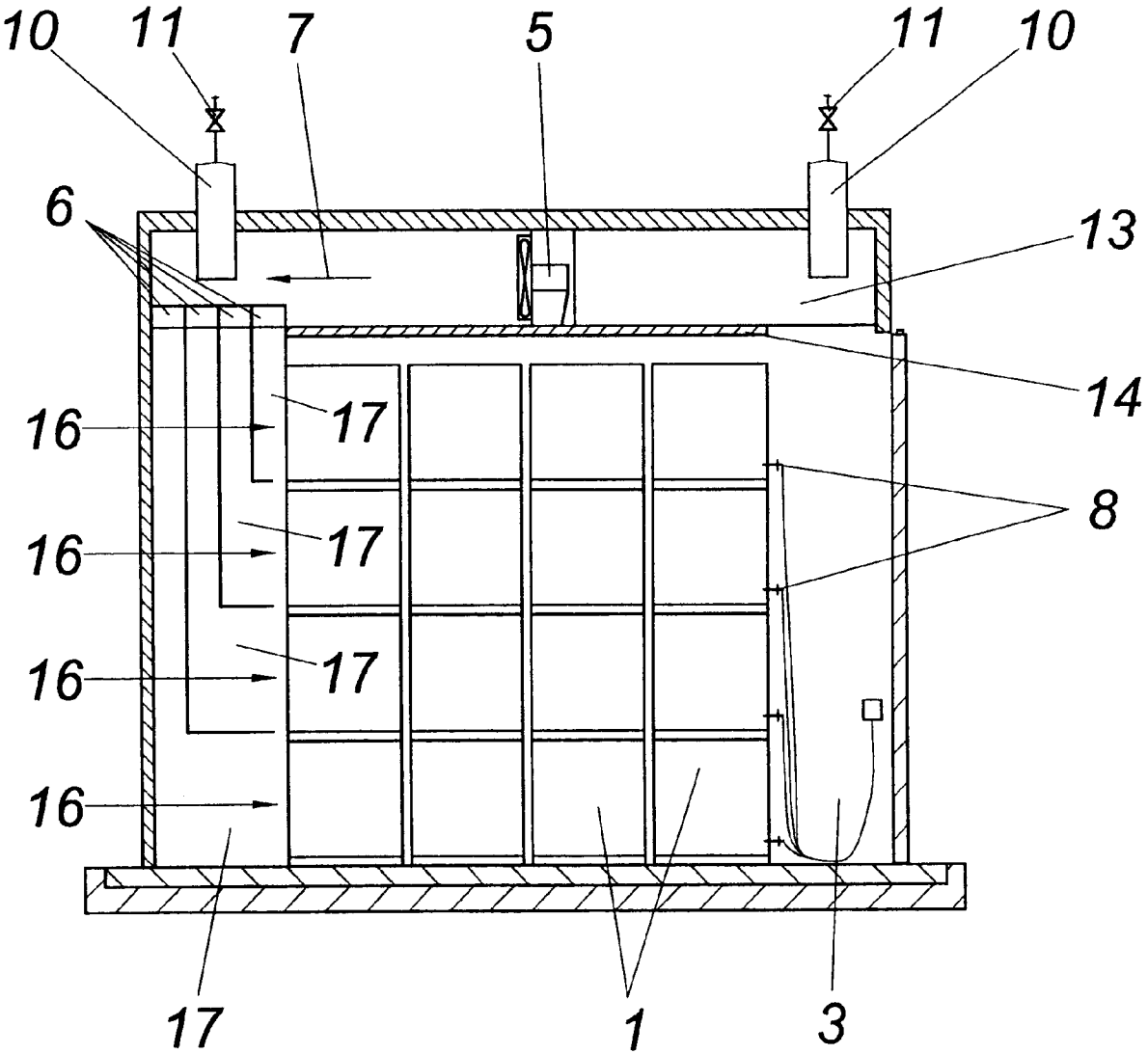
FIG. 4 shows a variant of the apparatus of FIG. 3.

In order to enable the compensation of differences in moisture within the individual zones 2, they are subdivided into sub-zones 16 (FIG. 4), with separate drying gas conduits 17 being additionally arranged for each sub-zone 16. Heat exchangers 6 which can be triggered or regulated separately from each other are associated with the individual sub-zones 16 in order to allow the thermal power supplied to the individual sub-zones to be regulated independently.

What is claimed is:

1. A method for drying stacked wood with the help of a drying gas guided in a circulatory flow, with the stacks of wood being charged zone by zone depending on the average moisture of the wood in the respective zone with partial streams of the drying gas which differ with respect to their drying power, characterized in that the stacks of wood (H1, H2) are dried in the zone with the on average highest wood moisture (u) with a permissible maximum speed up to the fiber saturation point (F) and the other zones (2) are dried within the terms of achieving the fiber saturation point with different speeds in the time interval as predetermined by the zone with the most moisture before the stacks of wood (H1, H2) are dried in an even circulatory flow to the predetermined final moisture (E), and that the average moisture of the wood used for determining the drying speeds is determined in a heat-up phase (A) from the heat quantity supplied to the wood.

2. A method as claimed in claim 1, characterized in that the mean moisture of the wood is determined zone by zone during the heat-up phase (A) of the drying gas in circulation from the heat quantity supplied to the wood during an observation period.

3. A method as claimed in claim 1, characterized in that the heat quantity supplied to the wood is determined from the product of the temperature difference between the entrance of the drying gas into and the exit out of the stack with the mass of the circulated drying gas per unit of time and a material constant of the drying gas.

4. A method as in claim 1, characterized in that the heat quantity which is emitted to the drying gas by a heat exchanger (6) and supplied to the wood is determined from the product of the temperature difference between advance flow temperature and return flow temperature of the heat exchanger with the mass of the heating medium circulated per unit of time in the heat exchanger (6) and a material constant of the heating medium.

5. A method as claimed in claim 1, characterized in that the wood temperature can be measured during the heat-up phase (A) at at least one point per zone and can be supplied to a memory unit (4), with mass of the water contained in the wood then being determined from the heat quantity supplied during the observation period to the wood and the wood temperature difference between the beginning and end of the observation period with knowledge of the volume of wood to be dried.

6. A method as claimed in claim 1, characterized in that the drying speed to be maintained for each zone during the drying phase is controlled by the quantity of drying gas replaced by fresh gas.

7. A method as claimed in claim 1, characterized in that the stack exit temperature of the drying gas is regulated in all zones (2) to a uniform value.

8. (Attended) A method as claimed in claim 1, characterized in that the same quantity of drying gas is exchanged in each zone (2) per unit of time and the stack exit temperature of the drying gas is controlled in all zones (2) depending on the drying speed to be maintained.

9. (Attended) A method as claimed in claim 1, characterized in that individual zones (2) are subdivided into subzones (16) in which the stack exit temperature of the drying gas is controlled depending on the drying speed to be maintained.

* * * * *